US006771924B2

(12) United States Patent
Matsuguma

(10) Patent No.: US 6,771,924 B2
(45) Date of Patent: Aug. 3, 2004

(54) IMAGE FORMING APPARATUS HAVING DIFFERENT MODES FOR PREVENTING DEFECTIVE CLEANING

(75) Inventor: Minoru Matsuguma, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 10/233,510

(22) Filed: Sep. 4, 2002

(65) Prior Publication Data

US 2003/0063928 A1 Apr. 3, 2003

(30) Foreign Application Priority Data

Sep. 4, 2001 (JP) ..... 2001-267871
Jan. 23, 2002 (JP) ..... 2001-014465

(51) Int. Cl.[7] ..... G03G 15/01; G03G 21/00
(52) U.S. Cl. ..... 399/299; 399/343; 399/350
(58) Field of Search ..... 399/298, 299, 399/302, 343, 344, 350

(56) References Cited

U.S. PATENT DOCUMENTS 4,875,081 A * 10/1989 Goffe et al. ..... 399/350
6,108,510 A * 8/2000 Nakane ..... 399/298
6,356,732 B1 * 3/2002 Watanabe et al. ..... 399/299
6,477,348 B2 * 11/2002 Miyamoto et al. ..... 399/299
6,522,856 B2 * 2/2003 Nakayama ..... 399/350

* cited by examiner

*Primary Examiner*—Fred L Braun
(74) *Attorney, Agent, or Firm*—Fitzpatrick, Cella, Harper & Scinto

(57) ABSTRACT

In a color image forming apparatus of a tandem type, a full color image forming mode and a monochrome image forming mode are made selectable. In the monochrome image forming mode, toner is supplied between photosensitive drums for colors that do not contribute to image formation and cleaning devices therefor. Consequently, defective cleaning can be prevented and formation of high quality images becomes possible.

28 Claims, 10 Drawing Sheets

(A)

(B)

IMAGE FORMING APPARATUS HAVING DIFFERENT MODES FOR PREVENTING DEFECTIVE CLEANING

BACKGROUND OF THE INVENTION

1. Field of the Invention

The present invention relates to an image forming apparatus of an electrophotographic process or the like for forming an image using a plurality of image bearing members (e.g., photosensitive members).

As the image forming apparatus of the electrophotographic process, there are, for example, an electrophotographic copying machine, an electrophotographic printer (e.g., an LED printer and a laser beam printer) and an electrophotographic facsimile machine.

2. Description of the Related Art

In recent years, with the spread of a color image forming apparatus according to the electrophotographic process, a demand for speed-up of color output has been increasing in addition to a demand for a recording quality of a color image. In order to meet these demands, there have been made several proposals with respect to an image forming process.

For example, a color image farming apparatus of a tandem type uses a plurality of photosensitive drums arranged side by side. The color image forming apparatus forms a toner image of each color of black, cyan, magenta and yellow on each photosensitive drum. Then, the toner images are sequentially transferred to a transfer material, which is conveyed by a transfer material conveyor belt, by respective transferring means. Thereafter, the toner images are fixed by a fixing device.

FIGS. 3 and 4 are sectional views of a conventional color image forming apparatus of the tandem type. As shown in FIGS. 3 and 4, transfer materials S are set in a sheet feeding cassette 101 inserted in a lower part of an apparatus main body. The transfer materials S are fed by a sheet feed roller 102 and sent to a registration roller pair 104.

There is provided a transfer material conveyor belt 105 for conveying the transfer materials S on a downstream side in a conveying direction of transfer materials of the registration roller pair 104. The transfer material conveyor belt 105 is stretched and suspended flatly in the conveying direction of transfer materials (vertical direction of FIG. 3) by a plurality of rotation rollers such as a drive roller 106, a driven roller 107 and a tension roller 108. An attracting roller 109 is arranged in a most upstream part in the conveying direction of transfer materials of the transfer material conveyor belt 105. The attracting roller 109 is brought into pressed contact with the driven roller 107 via the transfer material conveyor belt 105.

A predetermined bias voltage is applied to the attracting roller 109. Consequently, the transfer material S, which is conveyed onto the transfer material conveyor belt 105 at good timing by the registration roller pair 104, is electrostatically attracted by the transfer material conveyor belt 105 to be conveyed.

Four photosensitive drums of yellow, magenta, cyan and black 110*y*, 110*m*, 110*c* and 110*k* (hereinafter simply referred to as "photosensitive drums 110") are linearly arranged in order from the lower side to the upper side of FIG. 3 to be opposed to the transfer material conveyor belt 105.

Primary chargers 111*y*, 111*m*, 111*c* and 111*k* (hereinafter simply referred to as "primary chargers 111"), developing devices 112*y*, 112*m*, 112*c* and 112*k* (hereinafter simply referred to as "developing devices 112") and cleaning means 113*y*, 113*m*, 113*c* and 113*k* (hereinafter simply referred to as "cleaning means 113") are arranged around the respective photosensitive drums 110. In addition, transfer members 114*y*, 114*m*, 114*c* and 114*k* (hereinafter simply referred to as "transfer members 114") are arranged opposite to the photosensitive drums 110 across the transfer material conveyor belt 105.

Toner of each color is contained inside toner containers of the developing devices 112. Toner images of each color are formed on the photosensitive drums 110 by a well-known image forming process and are sequentially transferred to the transfer material S, which is conveyed by the transfer material conveyor belt 105, to form a color image.

The transfer material S having the toner image transferred thereon is self-stripped in the position of the drive roller 106 and guided to a fixing roller pair 115. The transfer material S is subjected to heating and pressurizing processing while it is nipped and conveyed by the fixing roller pair 115, and the toner image is permanently fixed. Thereafter, the transfer material S is conveyed by a discharge roller pair 116 and discharged onto a discharge tray 117 arranged in the upper part of the apparatus main body.

In the color image forming apparatus as described above, multicolor printing, that is, full color image formation is not always performed but a frequency of performing recording of single color of black, that is, monochrome image formation is also relatively high. Leaving developing rollers in contact with photosensitive drums that do not perform image formation even in such a case contributes to generation of fog or the like and is not preferable.

Therefore, in order to cope with such a method of use, there is proposed a color image forming apparatus of a tandem type that is constituted such that a contact or non-contact state of photosensitive drums and developing rollers can be appropriately switched in association with a case of full color image formation and a case of monochrome image formation.

For example, as shown in FIG. 3, image bearing members and developing rollers are in a contact state at the time of full color image formation. On the other hand, at the time of monochrome image formation, as shown in FIG. 4, switching means 118 (118*y*, 118*m*, 118*c* and 118*k*) for switching contact and non-contact of the image bearing members and the developing rollers push up a part of bottoms of developing devices to lift them upward in FIG. 4 to separate developing rollers 100 from photosensitive drums 110 other than that of black to make them non-contact. Thus, only a black image is recorded.

Constituting the color image forming apparatus in this way, a route of the transfer material S conveyed from the attracting roller 109 to the fixing roller pair 115 through a black image forming portion does not change in the case of full color image formation and the case of monochrome image formation, and a stable conveying performance is realized.

However, in the aforementioned conventional example, if a large number of monochrome images are formed, an abutment state of a cleaning blade tends to be unstable in process cartridges other than that for black. This is because, since the photosensitive drums and the developing rollers are not in contact with each other, toner hardly moves to the photosensitive drums and toner as lubricant decreases in rubbing parts of photosensitive drums and the cleaning blades. When the abutment state of the cleaning blades becomes unstable, it is likely that defective cleaning such as toner slipping or image defectiveness due to contamination of a charging member is caused. In the worst case, it is likely that damages such as tucking of cleaning blades are caused.

SUMMARY OF THE INVENTION

The present invention has been devised in view of the above and other drawbacks, and it is an object of the present invention to provide an image forming apparatus in which defective cleaning by cleaning means is prevented.

It is another object of the present invention to provide an image forming apparatus that is capable of performing image formation at a high speed using a plurality of image bearing members.

It is another object of the present invention to provide an image forming apparatus in which an abutment state of an image bearing member, on which an image is not formed, among a plurality of image bearing members and cleaning means is stabilized.

It is another object of the present invention to provide an image forming apparatus in which developer is supplied between an image bearing member on which an image is not formed and cleaning means.

It is yet another object of the present invention to provide an image forming apparatus that is capable of obtaining a high quality image steadily even if a large number of images are formed on some of a plurality of image bearing members.

Other objects and characteristics of the present invention will be more apparent by reading the following detailed descriptions with reference to the accompanying drawings.

DESCRIPTION OF THE PREFERRED EMBODIMENTS

Preferred embodiments of the present invention will be described in detail illustratively with reference to the accompanying drawings. Note that dimensions, materials, shapes and a relative arrangement of components described in the embodiments are not meant to limit a scope of the present invention only to them unless specifically described otherwise.

First Embodiment

Figure 1:
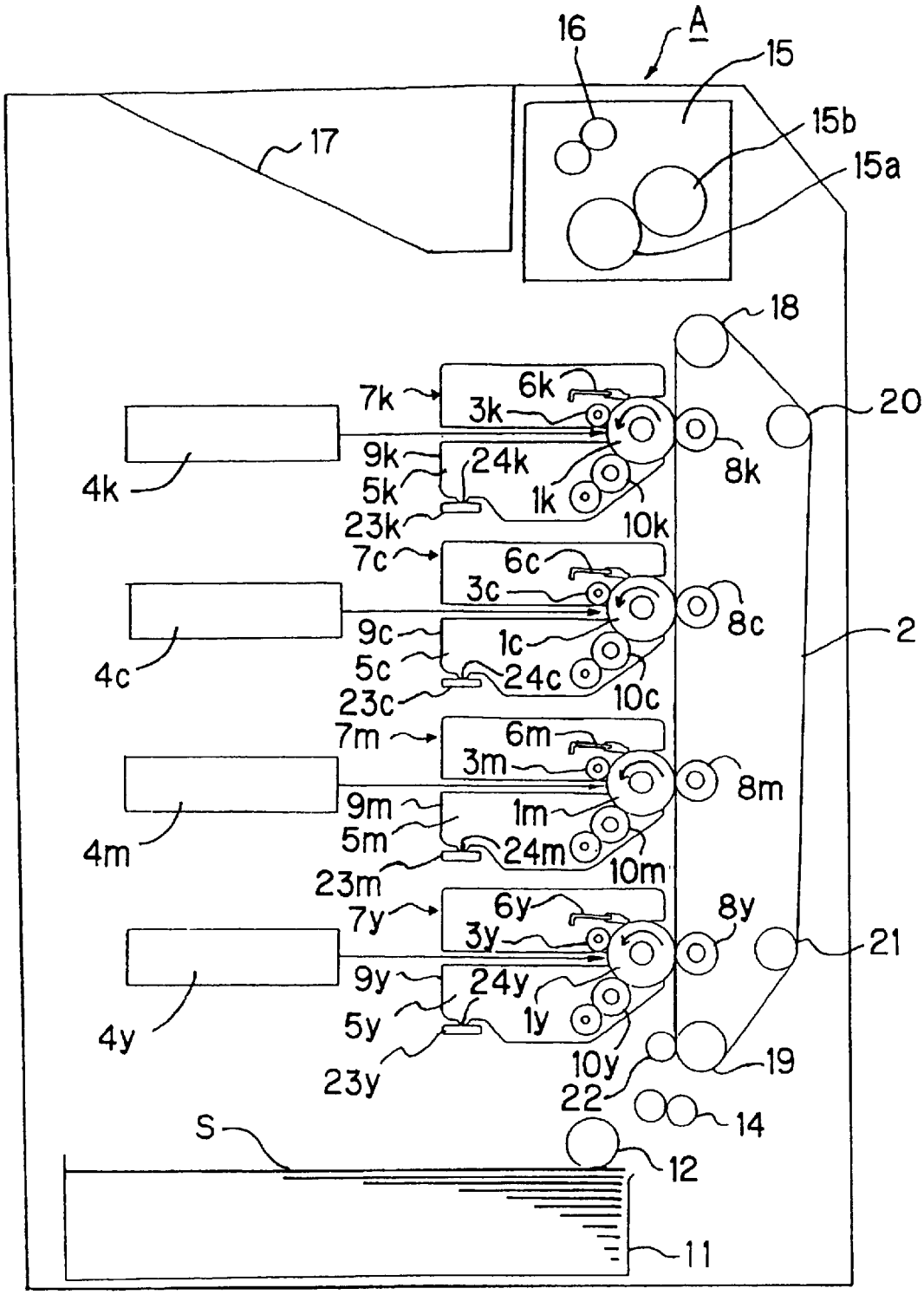
FIG. 1 is a sectional explanatory view showing a structure of an image forming apparatus in accordance with a first embodiment.
Figure 2:
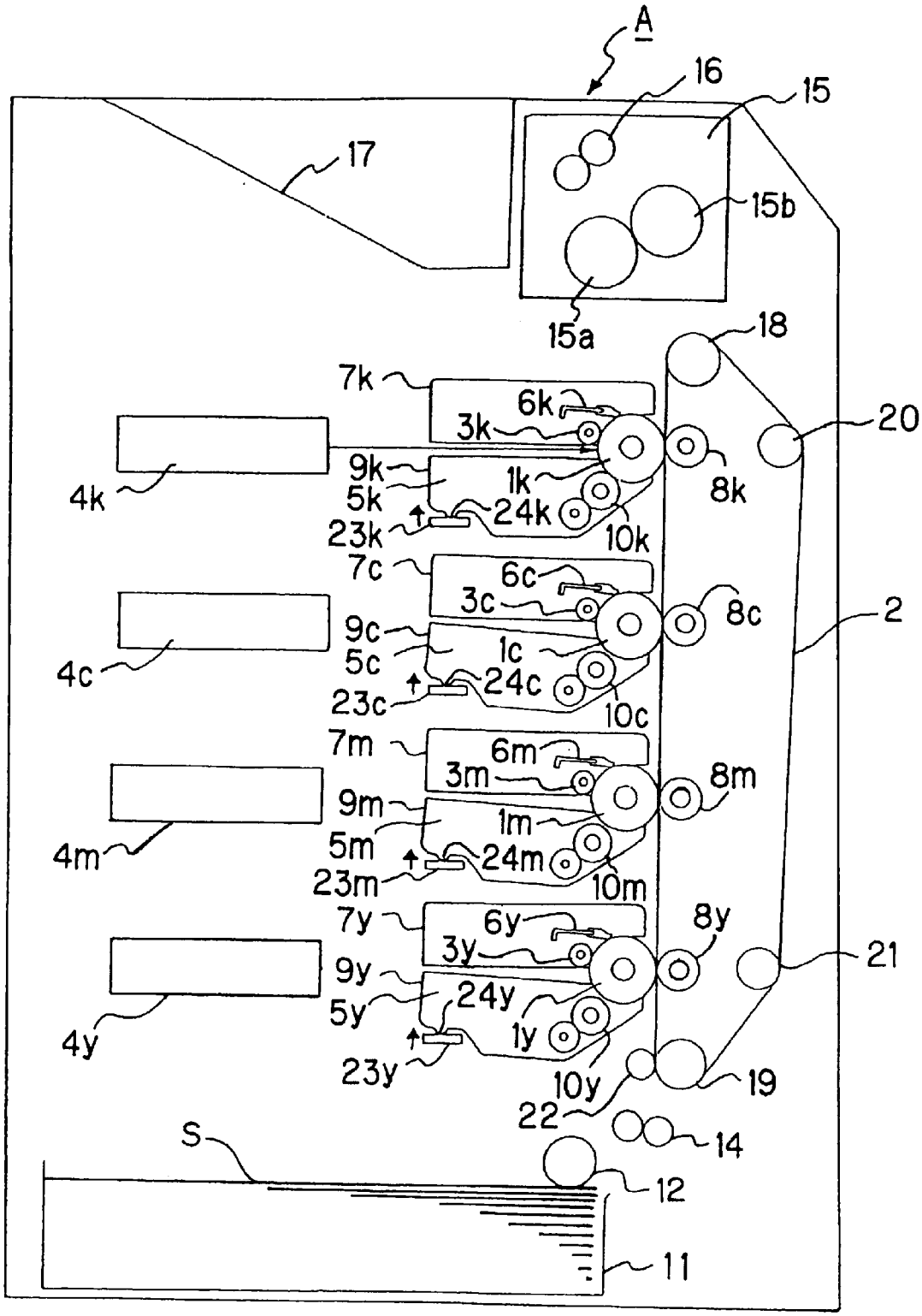
FIG. 2 is a sectional explanatory view showing the structure of the image forming apparatus in accordance with the first embodiment.
Figure 3:
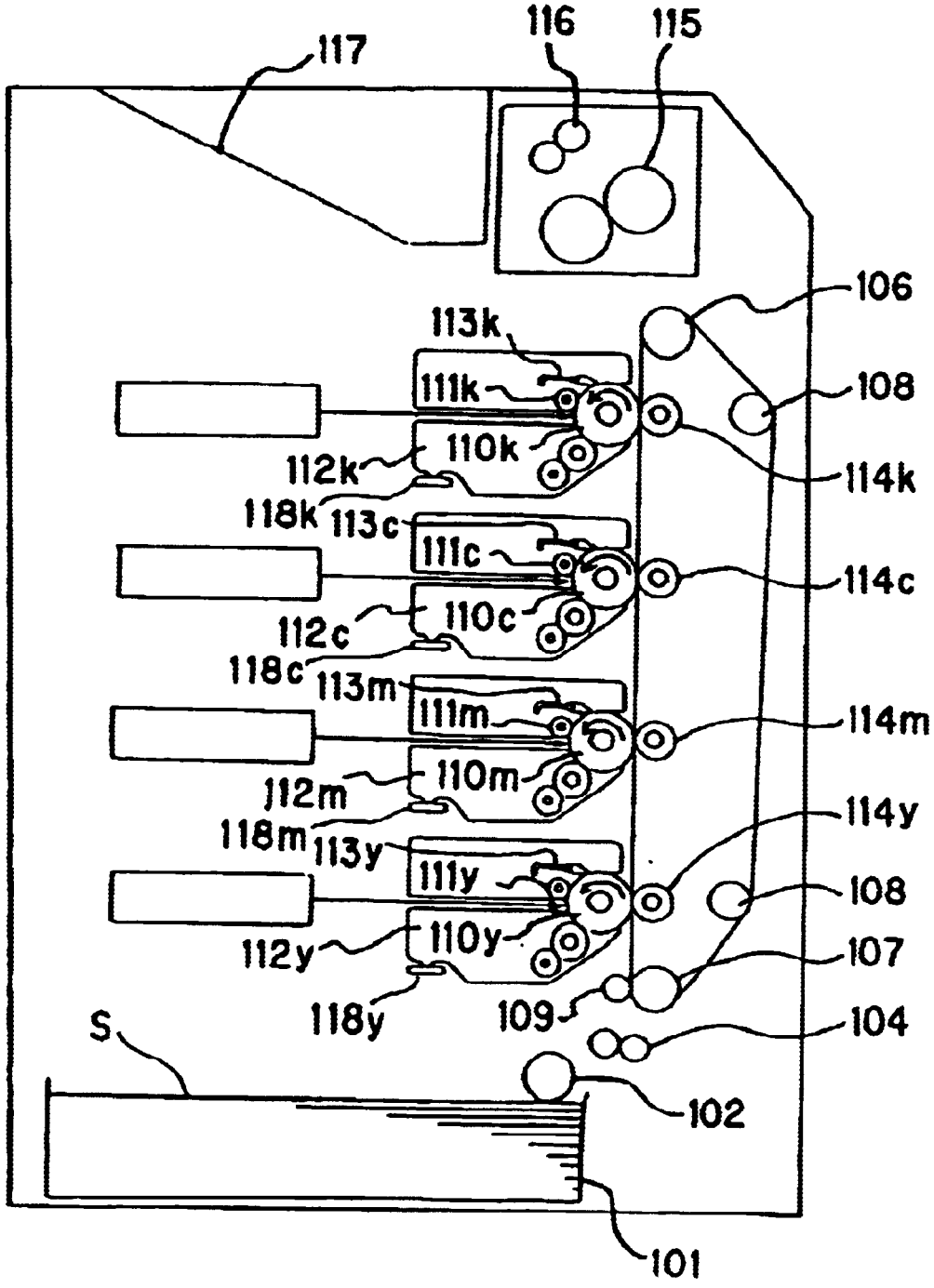
FIG.3 PRIOR ART
FIG. 3 is a sectional view illustrating a conventional example.
Figure 4:
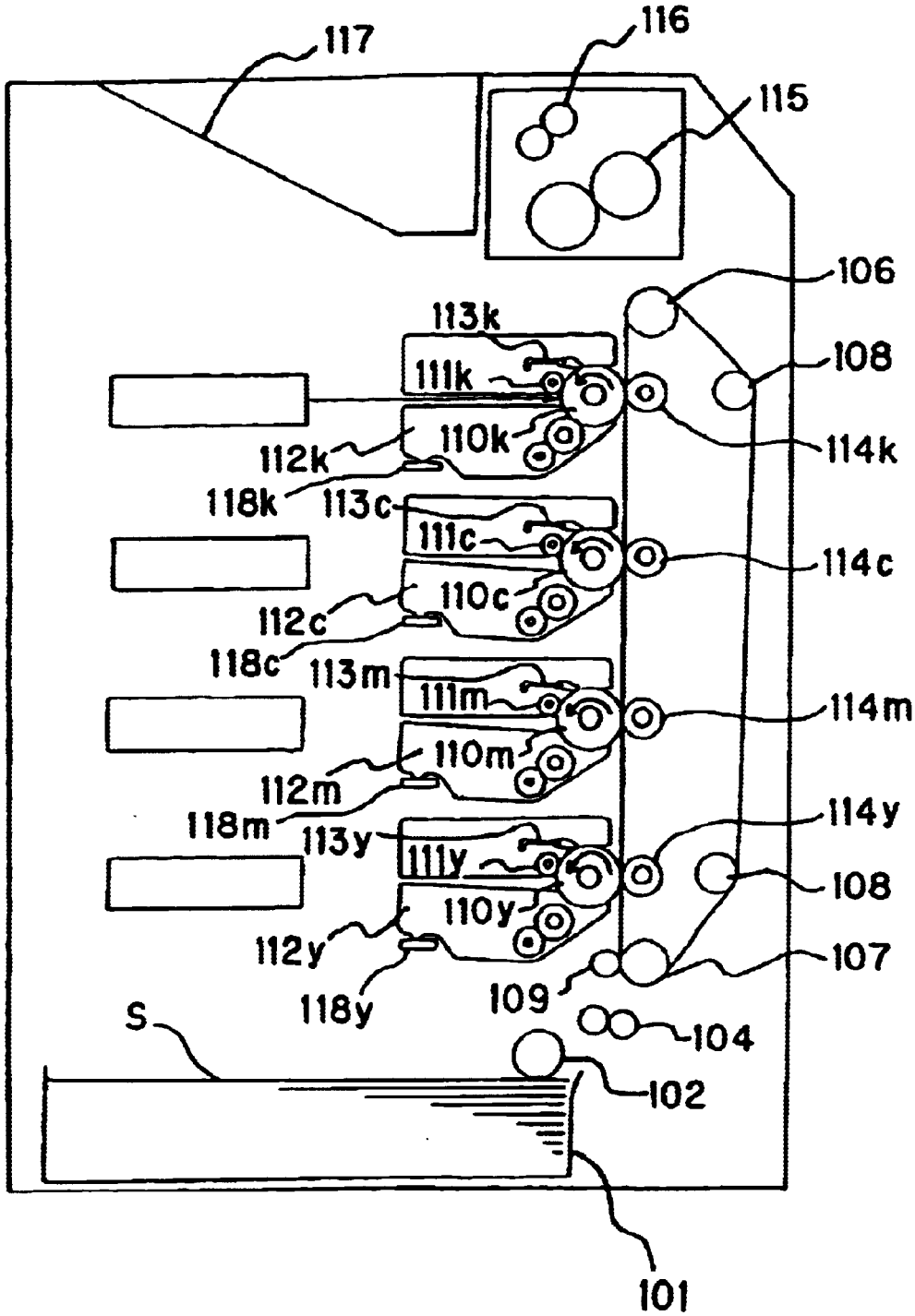
FIG.4 PRIOR ART
FIG. 4 is a sectional view illustrating the conventional example.

An embodiment of an image forming apparatus in accordance with the present invention will be described specifically with reference to drawings. FIGS. 1 and 2 are sectional explanatory views showing a structure of the image forming apparatus in accordance with the present invention. FIG. 1 shows a state in which full color image formation is performed in a full color image forming mode as a first image forming mode. FIG. 2 shows a state in which monochrome image formation is performed in a monochrome image forming mode as a second image forming mode.

In FIGS. 1 and 2, a color image forming apparatus (printer) A is provided with four electrophotographic photosensitive drums 1*y*, 1*m*, 1*c* and 1*k* (hereinafter simply referred to as "photosensitive drums 1") functioning as image bearing members that are linearly arranged one behind the other in a vertical direction of FIGS. 1 and 2. A transfer material conveyor belt 2 is arranged to be opposed to each photosensitive drum 1. The transfer material conveyor belt 2 functions as transfer material conveying means (image receiving member carrying body) for attracting a transfer material S functioning as an image receiving member by electrostatic attraction to convey it. Each photosensitive drum 1 is provided in contact with the transfer material conveyor belt 2.

The respective photosensitive drums 1 are arranged such that the two photosensitive drums 1*m* and 1*c* of magenta and cyan in the middle project to the transfer material conveyor belt 2 side by approximately 1 mm compared with the photosensitive drums 1*y* and 1*k* of yellow and black in upper and lower ends of FIG. 1. The photosensitive drums 1 are driven to rotate in a counterclockwise direction of FIG. 1 by driving means (not shown).

Around each photosensitive drum 1, there are arranged, in order from an upstream side of its rotation, primary chargers 3*y*, 3*m*, 3*c* and 3*k* (hereinafter simply referred to as "primary chargers 3") functioning as charging means for uniformly charging the surfaces of the photosensitive drums 1 and exposing means 4*y*, 4*m*, 4*c* and 4*k* (hereinafter simply referred to as "exposing means 4") for irradiating a laser beam on the surfaces of the photosensitive drums 1, which are uniformly charged negatively by the primary chargers 3, based on image information to form electrostatic latent images.

Moreover, there are arranged developing means 5*y*, 5*m*, 5*c* and 5*k* (hereinafter simply referred to as "developing means 5") for depositing toner of each color (negatively charged polarity) on the surfaces of the photosensitive drums 1 on which electrostatic latent images are formed to visualize the electrostatic latent images as toner images and cleaning means 6*y*, 6*m*, 6*c* and 6*k* (hereinafter simply referred to as "cleaning means 6") for removing toner remaining on the surfaces of the photosensitive drums 1 after transfer.

The photosensitive drums 1, the primary chargers 3, the developing means 5 and the cleaning means 6 are detachably attachable to an apparatus main body of the printer A as process cartridges 7*y*, 7*m*, 7*c* and 7*k* (hereinafter simply referred to as "process cartridges 7") in which they are integrally constituted as cartridges.

Here, the cartridge means one having at least one of an electrophotographic photosensitive member, charging means for charging the electrophotographic photosensitive member, developing means for supplying developer to the electrophotographic photosensitive member and cleaning means for cleaning the electrophotographic photosensitive member. In particular, the process cartridge means one in which at least one of charging means, developing means and cleaning means and an electrophotographic photosensitive member are integrally constituted as a cartridge and the cartridge is made detachably attachable to an image forming apparatus main body.

In addition, transfer rollers 8*y*, 8*m*, 8*c* and 8*k* (hereinafter simply referred to as "transfer rollers 8") are arranged in positions opposed to respective photosensitive drums 1 across the transfer material conveyor belt 2. The transfer rollers 8 are transferring means for transferring toner images formed on the surfaces of the photosensitive drums 1 to a transfer material S conveyed by the transfer material conveyor belt 2.

The photosensitive drums 1 functioning as image bearing members are constituted by applying organic photoconductive layers (OPC) on external circumference surfaces of aluminum cylinders with a diameter of 30 mm. The photosensitive drums 1 are rotatably supported via flanges at their both end portions and are driven to rotate in the counterclockwise direction of FIG. 1 by transmitting a driving force from a driving motor (not shown) to one end portions.

The primary chargers 3 have conductive rollers formed in a roller shape. The primary chargers 3 come into abutment with the conductive rollers against the surfaces of the photosensitive drums 1 and, at the same time, charge the surfaces of the photosensitive drums 1 uniformly by applying a charging bias voltage by a power supply (not shown).

The exposing means 4 have polygon mirrors. Image light corresponding to an image signal is irradiated on the polygon mirror from a laser diode (not shown).

The developing means 5 are provided with toner containing portions 9*y*, 9*m*, 9*c* and 9*k* (hereinafter simply referred to as "toner containing portions 9") containing toner of each color of yellow, magenta, cyan and black, respectively, developing rollers 10*y*, 10*m*, 10*c* and 10*k* (hereinafter simply referred to as "developing rollers 10") functioning as developer carrying members adjacent to the surfaces of the photosensitive drums 1, and the like. The developing means 5 perform reversal development by applying a developing bias voltage to the developing rollers 10 which are driven to rotate by a driving unit (not shown) by a developing bias power supply (not shown).

Toner of yellow, magenta, cyan and black is contained in the toner containing portion 9*y*, the toner containing portion 9*m*, the toner containing portion 9*c* and the toner containing portion 9*k*, respectively, in order from an upstream side in a conveying direction of the transfer material S.

The transfer rollers 8 arranged on the inner side of the transfer material conveyor belt 2 are opposed to the four photosensitive drums 1, respectively, to abut the transfer material conveyor belt 2. These transfer rollers 8 are connected to a transfer bias power supply (not shown). When a charge of positive polarity is applied to the transfer material S from the transfer rollers 8 via the transfer material conveyor belt 2, the toner images of each color of negative polarity on the surfaces of the photosensitive drums 1 are sequentially transferred to the transfer material S, which is in contact with the photosensitive drums, by this electric field. In this way, a color image is transferred to the transfer material S.

The transfer material S such as paper or synthetic resin, which is contained in a sheet feeding cassette 11 provided in the lower part of the main body of the printer A, is fed by a sheet feed roller 12 to be sent to a registration roller pair 14.

The transfer material S sent by the registration roller pair 14 at predetermined timing is conveyed to a transfer position between the photosensitive drums 1 functioning as image forming means and the transfer rollers 8 in the state in which it is electrostatically attracted and carried by the transfer material conveyor belt 2. The toner images formed on the surfaces of the respective photosensitive drums 1 are sequentially transferred to the transfer material Sand a color image is recorded thereon. Then, the transfer material S is subjected to heating and pressurizing processing when it passes fixing means 15, which has a heating roller 15*a* rotating for driving and a pressurizing roller 15*b* driven to rotate in pressed contact with the heating roller 15*a*, to have the toner images permanently fixed thereon. Thereafter, the transfer material S is discharged onto a discharge tray 17 provided in the upper part of the main body of the printer A by a discharge roller pair 16.

As described above, toner images of different colors are formed on the photosensitive drums, respectively, in the full color image forming mode. Each toner image is transferred to be superimposed on the transfer material on the transfer material conveyor belt 2.

Next, operations of image formation in the monochrome image forming mode will be described with reference to FIG. 2. FIG. 2 shows a state in which the image forming apparatus described above with reference to FIG. 1 is operated in the monochrome image forming mode. In both the figures, identical reference symbols denote identical members.

Separating members 23*y*, 23*m*, 23*c* and 23*k* (hereinafter simply referred to as "separating members 23") functioning as switching means are in abutment with projected parts 24*y*, 24*m*, 24*c* and 24*k* (hereinafter simply referred to as "projected parts 24") of the toner containing portions 9 of the process cartridges 7. The image forming apparatus of this embodiment moves the separating members 23 up and down, thereby rotating the developing devices 9 around pivots (not shown) to switch states of contact and non-contact of the photosensitive drums 1 and the developing rollers 10.

When image formation is performed in the monochrome image forming mode, the separating members 23 in abutment with the process cartridges 7 that do not contribute to the image formation are moved to lift the projected parts 24 to bring the photosensitive drums 1 and the developing rollers 10 into non-contact with each other. Consequently, a development operation is not performed. On the other hand, in the process cartridge 7 that contributes to the image formation, the development operation is performed in the state in which the photosensitive drum 1 and the developing roller 10 are in contact with each other.

Further, in this embodiment, the photosensitive drums 1 and the developing rollers 10 are relatively moved to abut or separate from each other, whereby the states of contact and non-contact are switched. However, for example, the states of contact and non-contact may be switched by increasing or decreasing an amount of developer on the developing rollers 10 while keeping the photosensitive drums 1 and the developing rollers 10 fixed to each other.

At the time of monochrome image formation, rotation of both the photosensitive drum 1 that contributes to the image formation and the photosensitive drums 1 that do not contribute to the image formation is maintained, and stable conveyability of a transfer material is realized by nipping it between the photosensitive drums and the transfer material conveyor belt 2.

For the process cartridge 7*k* for black that contributes to image formation, the separating member 23*k* is lowered and the photosensitive drum 1*k* and the developing means 5*k* are brought into abutment with each other. Thus, the process cartridge 7*k* develops a toner image of black and transfers the toner image to a conveyed transfer material S.

The cleaning means 6 are constituted by rubber blades and sheet metal. The cleaning means 6 bring their tips into abutment with the photosensitive drums 1 in a counter direction with respect to the rotation of the photosensitive drums 1 to scrape off transfer residual toner, fog toner of development, dirty toner due to jam processing, or the like on the photosensitive drums 1 to carry the toner to a waste toner containing portion.

For selection of the monochrome image forming mode and the full color image forming mode, for example, a user may input from a control panel of the image forming apparatus main body or the user may input using a computer connected to the image forming apparatus. The separating members 23 are moved appropriately according to the selection of the monochrome image forming mode and the full color image forming mode, whereby contact or non-contact with the photosensitive drums 1 and the development rollers 10 is determined, respectively.

Next, an operation for supplying toner to the image bearing members (photosensitive drums) 1*y*, 1*m* and 1*c* of a station on which images are not formed in the monochrome image forming mode will be described. Toner images corresponding to image information are not formed on the photosensitive drums 1*y*, 1*m* and 1*c* that do not contribute to image formation. Thus, here, a toner supply operation to the photosensitive drums is performed, whereby toner is supplied between the photosensitive drums on which images are not formed and cleaning blades. Consequently, defective cleaning such as tucking of blades can be prevented. The toner supply operation is applied to the photosensitive drums that do not contribute to image formation in the course of a series of image forming operations in the monochrome image forming mode.

As a method of performing the toner supply operation in this embodiment, a bias applied to the primary chargers 3 is turned OFF at the image non-forming time to reduce a drum surface potential, and a bias applied to developing means is turned ON to bring the developing rollers 10 and the photosensitive drums 1 of all the process cartridges 7 into abutment with each other and move toner on the developing rollers 10 to the photosensitive drums 1 by approximately half a circumference of the photosensitive drums 1. The toner can be supplied to parts of the photosensitive drums where a surface potential is low from the developing rollers 10 by performing reversal development. In this way, the toner supply operation from the developing rollers 10 to the photosensitive drums 1 is performed by changing the photosensitive drums 1 and the developing rollers 10 from the non-contact state to the contact state even in the process cartridges that do not contribute to the image formation.

In this case, a transfer bias is turned OFF, whereby the toner on the photosensitive drums 1 is conveyed to the cleaning means 6 without being transferred to the transfer material S or the transfer material conveyor belt 2. Thus, the toner is supplied to the cleaning means 6.

Here, the image non-forming time includes any time other than the time when the image forming apparatus operates the image bearing members and the developing means in order to form desired toner images on the image bearing members.

For example, the image non-forming time is a period from the time when the transfer material S is conveyed from the sheet feeding cassette 11 until the time when it reaches a transferring part, a period from the time when the transfer material S passes the transferring part until the time when it has an image fixed thereon by fixing means to be discharged to the outside of the apparatus, or, if a plurality of transfer materials S are conveyed, a period from the time when one transfer material S passes the transferring part until the time when the next transfer material S reaches the transferring part.

Next, an example of timing for performing the toner supply operation will be described.

A printer A as the image forming apparatus of this embodiment is provided with a counter (not shown) in its main body, and the counter is incremented by one every time an image is formed. When the counter reaches 100, the toner supply operation is performed and, at the same time, the counter is reset to zero such that sheet feeding is stopped once and the next transfer material S does not reach the transferring part. In this embodiment, the counter is reset also when a power supply of the printer A is turned on. When a plurality of images are formed continuously in the monochrome image forming mode, residual toner decreases between the photosensitive drums 1*y*, 1*m* and 1*c* that do not contribute to the image formation and the cleaning means 6, and the cleaning means 6 tend to be gradually tucked. Therefore, toner is forcibly supplied between the cleaning means 6 and the photosensitive drums 1 at appropriate timing before tucking of the cleaning means occurs. By performing the toner supply operation, lubricity between the photosensitive drums 1 and the cleaning means 6 is increased and tucking of the cleaning means 6 can be prevented.

In addition, in this embodiment, toner was supplied for approximately half a circumference of the photosensitive drums. A supply amount was approximately 3 mg a time.

When 10,000 images were formed by the image forming apparatus of this embodiment in the monochrome image forming mode, appropriate lubricity could be always maintained because toner always existed at the nips between the cleaning means 6 and the photosensitive drums 1, and favorable cleaning performance could be kept.

Therefore, it was confirmed that high image quality could be realized for a long period, for example, defective cleaning, charging unevenness or the like did not occur and uniform half tone images could be obtained even if full color printing was performed immediately after the monochrome image forming mode.

Second Embodiment

Next, a second embodiment of the present invention will be described with reference to FIG. 5.

Figure 5:
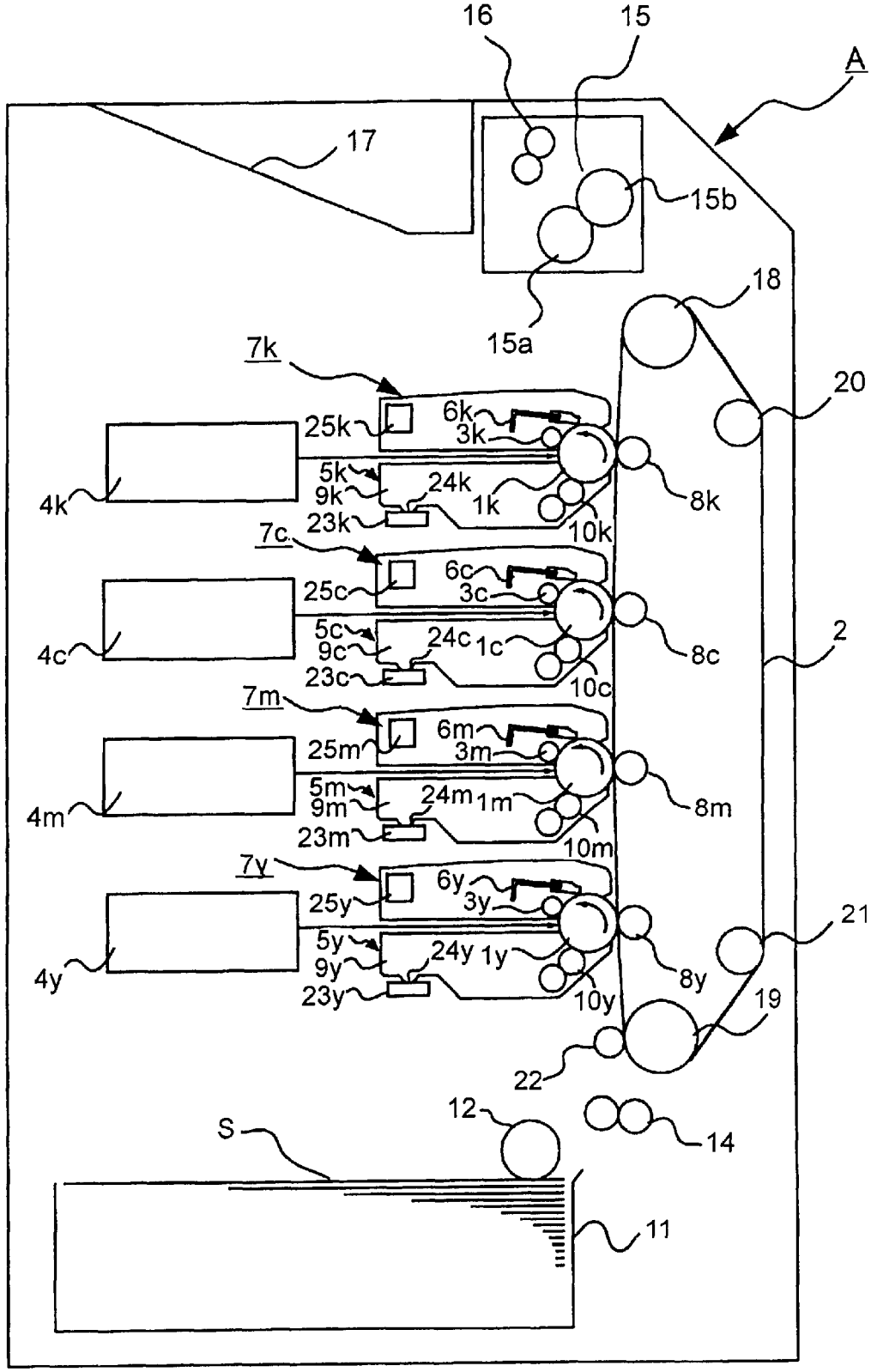
FIG. 5 is a sectional explanatory view showing a structure of an image forming apparatus in accordance with second and fifth embodiments.

In FIG. 5, the reference symbols identical to those in the first embodiment denote the identical members, and descriptions of the members will be omitted.

The process cartridges 7*y*, 7*m*, 7*c* and 7*k* are respectively provided with memory means 25*y*, 25*m*, 25*c* and 25*k* (hereinafter simply referred to as "memory means 25").

The printer A is provided with reading and writing means (not shown) for reading and writing information to be stored in the memory means 25. The printer A reads information (e.g., a value relating to a life of a process cartridge) calculated and obtained by a CPU (not shown) functioning as calculating means and is controlled according to information (e.g., timing for bringing the image bearing members and the developing means, which are not in contact, into contact with each other) written in the memory means. In particular, timing for supplying toner at the image non-forming time described in the first embodiment is determined according to degrees of wear of the photosensitive drums 1.

That is, since tucking of the cleaning means 6 tends to occur as the photosensitive drums 1 wear, the higher the degrees of wear of the photosensitive drums 1 become, the more frequently the toner supply operation for supplying toner between the photosensitive drums 1 and the cleaning means 6 is performed. It is needless to mention that this toner supply operation is applied to the photosensitive drums 1*y*, 1*m* and 1*c* that do not contribute to image formation in the monochrome image forming mode (see FIG. 6).

In this embodiment, calculation is performed such that a degree of wear represents a film thickness of the photosensitive drums 1. The calculation is performed using a method of weighting and adding a rotation time of the photosensitive drums, a primary charging bias application time (e.g., a time of an AC voltage to be applied to a charging member), a developing roller contact time and a transfer bias application time. In this case, weighting is performed such that a degree of wear is 0% initially and is 100% when a usable life is exhausted.

For example, when the toner supply operation was performed at every 5% of a degree of wear such as 5%, 10%, 15% and so on, the same timing as in the first embodiment was obtained.

Moreover, since deterioration of cleaning performance was fast at the end of a usable life of a process cartridge, when the toner supply operation was performed at every 4% after the degree of wear reached 80% such as 80%, 84%, 88% and so on in order to increase a frequency of toner supply, it became possible to increase qualities of images at the end.

Third Embodiment

In the above-mentioned first and second embodiments, developing rollers of all process cartridges are brought into abutment with each other to supply toner. On the other hand, in this embodiment, a developing roller of only a process cartridge of black is brought into abutment with a photosensitive drum as in the monochrome image forming mode to supply toner with developing rollers of the other process cartridges and photosensitive drums spaced apart from each other. More specifically, toner is moved onto a non-image area of the photosensitive drum 1*k* of the process cartridge of black, and a transfer bias is turned ON to further move the toner on the photosensitive drum 1*k* of black onto the transfer material conveyor belt 2. Then, the black toner is carried on the transfer material conveyor belt 2 and sequentially moved to the photosensitive drums 1*y*, 1*m* and 1*c* from the transfer material conveyor belt 2 to supply toner to the cleaning means 6.

According to this method, throughput of image formation at the time of the monochrome image forming mode can be increased compared with the method of bringing the developing rollers into abutment or separating them to supply toner. In addition, naturally, high image quality can be maintained for a long time by supplying toner to the nips between the cleaning means 6 and the photosensitive drums 1.

In addition, during image formation in the full color image forming mode, toner may be supplied as described in the first embodiment and, during image formation in the monochrome image forming mode, toner may be supplied as described in this embodiment.

Fourth Embodiment

In this embodiment, in an image forming apparatus of the same structure as the second embodiment provided with the memory means 25 in the process cartridges 7, timing of a toner supply operation is stored in advance in memory means. The printer A performs the toner supply operation according to the stored timing.

For example, timing values of 0%, 5%, 10%, 15% and so on are stored in the memory means, and the printer A reads these stored timing values for comparison. When forming an image, the printer A compares a timing value for forming an image with the read timing value for comparison and, if they are equal, supplies toner.

Moreover, as values to be stored, a predetermined number of images as described in the first embodiment may be used. In this case, the predetermined number of images are read when a power supply is ON. The printer A compares the predetermined number of images with the number of images that are formed since the power supply is turned ON to judge timing for supplying toner and perform a toner supply operation.

As described above, according to the above-mentioned first to fourth embodiments, toner is supplied to the nips between the cleaning means and the image bearing members at the predetermined timing. Thus, even if a large number of images are formed in the monochrome image forming mode, stable cleaning can be performed on the image bearing members that do not contribute to image formation.

In addition, since the memory means that store timing for supplying toner are provided in the process cartridges to make it possible to change timing for supplying toner according to degrees of wear of the photosensitive drums, more stable cleaning can be performed even at the end of a usable life of the photosensitive drums.

Therefore, in an image forming apparatus of a structure in which the developing rollers and the photosensitive drums come into non-contact with each other at the time of the monochrome image forming mode, high quality images could be realized steadily without defective cleaning, density unevenness of half tone, or the like.

Fifth Embodiment

Figure 6:
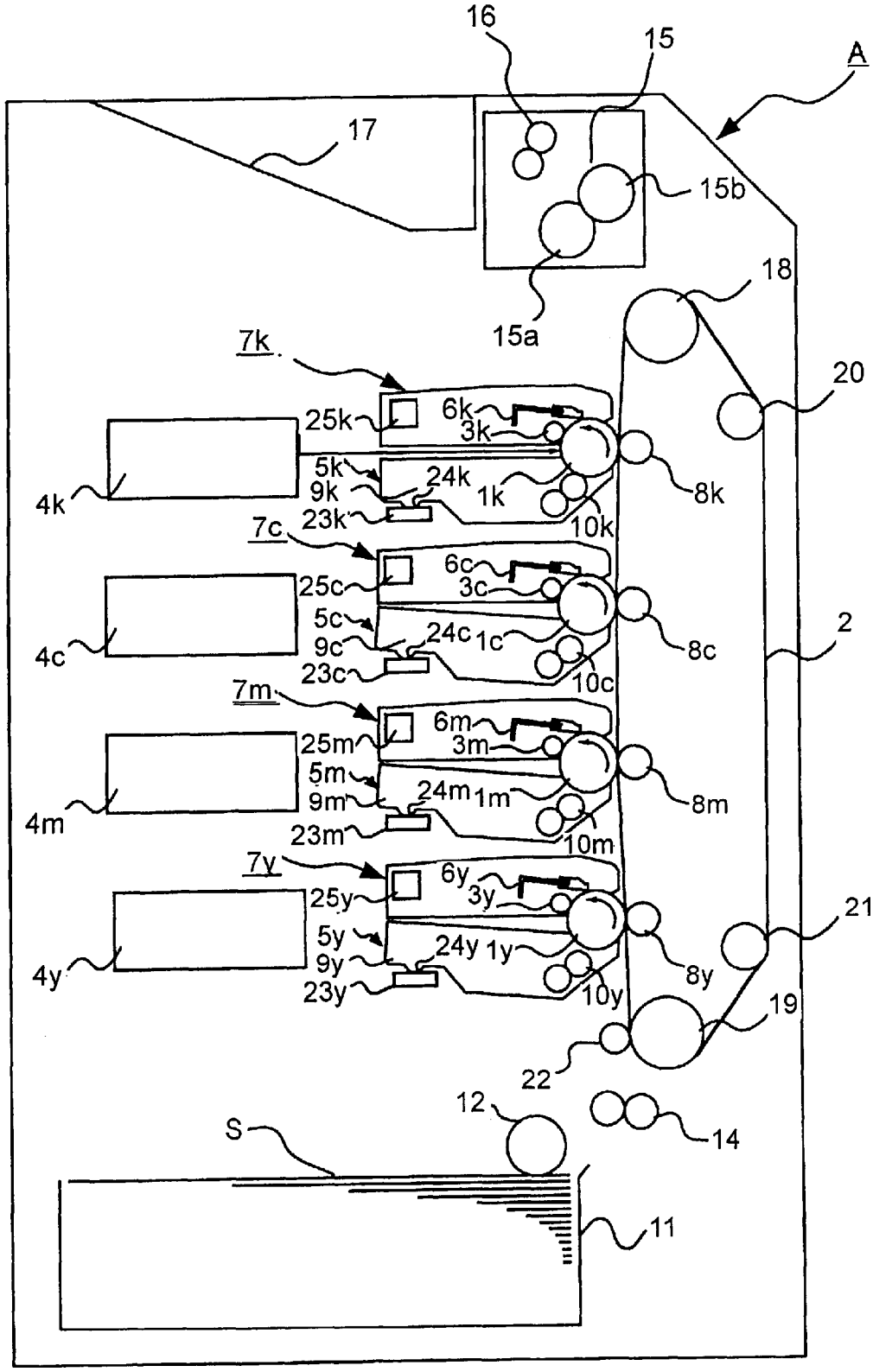
FIG. 6 is a sectional view showing the structure of the image forming apparatus in accordance with the second and fifth embodiments.

In this embodiment, a toner supply amount at the time of a toner supply operation is changed according to degrees of wear of the photosensitive drums 1. Image formation in the full color image forming mode and image formation in the monochrome image forming mode are the same as those in the first embodiment. FIG. 5 shows image formation in the full color image forming mode, and FIG. 6 shows image formation in the monochrome image forming mode. As described in the first embodiment, in the full color image forming mode, the photosensitive drum 1 and the developing rollers 10 come into contact with each other in each image forming station, whereby a development operation is performed and toner images of each color are superimposed and transferred to a transfer material carried by the transfer material conveyor belt 2 from each photosensitive drum 1. On the other hand, in the monochrome (mono-color) image forming mode, although the photosensitive drum 1*k* and the developing roller 10*k* are brought into contact with each other, the photosensitive drums 1*y*, 1*m* and 1*c* and the developing rollers 10*y*, 10*m* and 10*c* are not in contact with each other. Thus, only a black toner image is formed and transferred to a transfer material carried by the transfer material conveyor belt 2.

A toner supply operation is applied to the photosensitive drums that do not contribute to image formation in the course of a series of image forming operations in the monochrome image forming mode. That is, although the photosensitive drums 1 and the developing rollers 10 that do not contribute to image formation are not in contact with each other as shown in FIG. 6, the photosensitive drums 1 and the developing rollers 10 are brought into contact with each other to supply toner to the photosensitive drums 1 from the developing rollers 10 when a toner supply operation is performed as shown in FIG. 5. Consequently, toner is supplied between the photosensitive drums 1 and the cleaning means 6. As in the second embodiment, timing for the toner supply operation is determined according to degrees of wear of the photosensitive drums 1.

As in the second embodiment shown in FIG. 5, the plurality of process cartridges 7*y*, 7*m*, 7*c* and 7*k* are provided with the memory means 25*y*, 25*m*, 25*c* and 25*k* (hereinafter simply referred to as "memory means 25"), respectively. The printer A is provided with reading and writing means (not shown) for reading and writing information to be stored in the memory means 25. The printer A reads a value relating to a usable life of process cartridges calculated and obtained by a main body CPU (not shown) from the memory means 25 and is further controlled according to information written in the memory means 25. Then, a toner supply amount at the time of the toner supply operation is changed according to degrees of wear of the photosensitive drums 1.

In this embodiment, calculation is performed such that a degree of wear represents a thickness of the photosensitive drums 1. The calculation is performed using a method of adding a rotation time of the photosensitive drums, which is multiplied by a weighting coefficient according to a state affecting degrees of wear of the photosensitive drums such as ON/OFF of a primary charging bias, ON/OFF of contact of developing rollers, ON/OFF of a transfer bias and a process speed, to values stored in the memory means 25. In this case, weighting is performed such that a degree of wear is 0% initially and is 100% when a usable life is exhausted.

Moreover, set values of times for performing a toner supply operation are stored in the memory means 25 in advance in a form of degrees of wear of the photosensitive drums 1. In addition, set values representing a toner supply amount at the time of the toner supply operation in the above-mentioned each time are also stored. Moreover, it is also stored in the memory means 25 in which time, that is, at which degree of wear a process cartridge in use supplies toner next. The memory means 25 is basically provided with a function of performing both reading and writing as well. The operations of reading and wiring can be performed in a non-contact manner.

Figure 7:
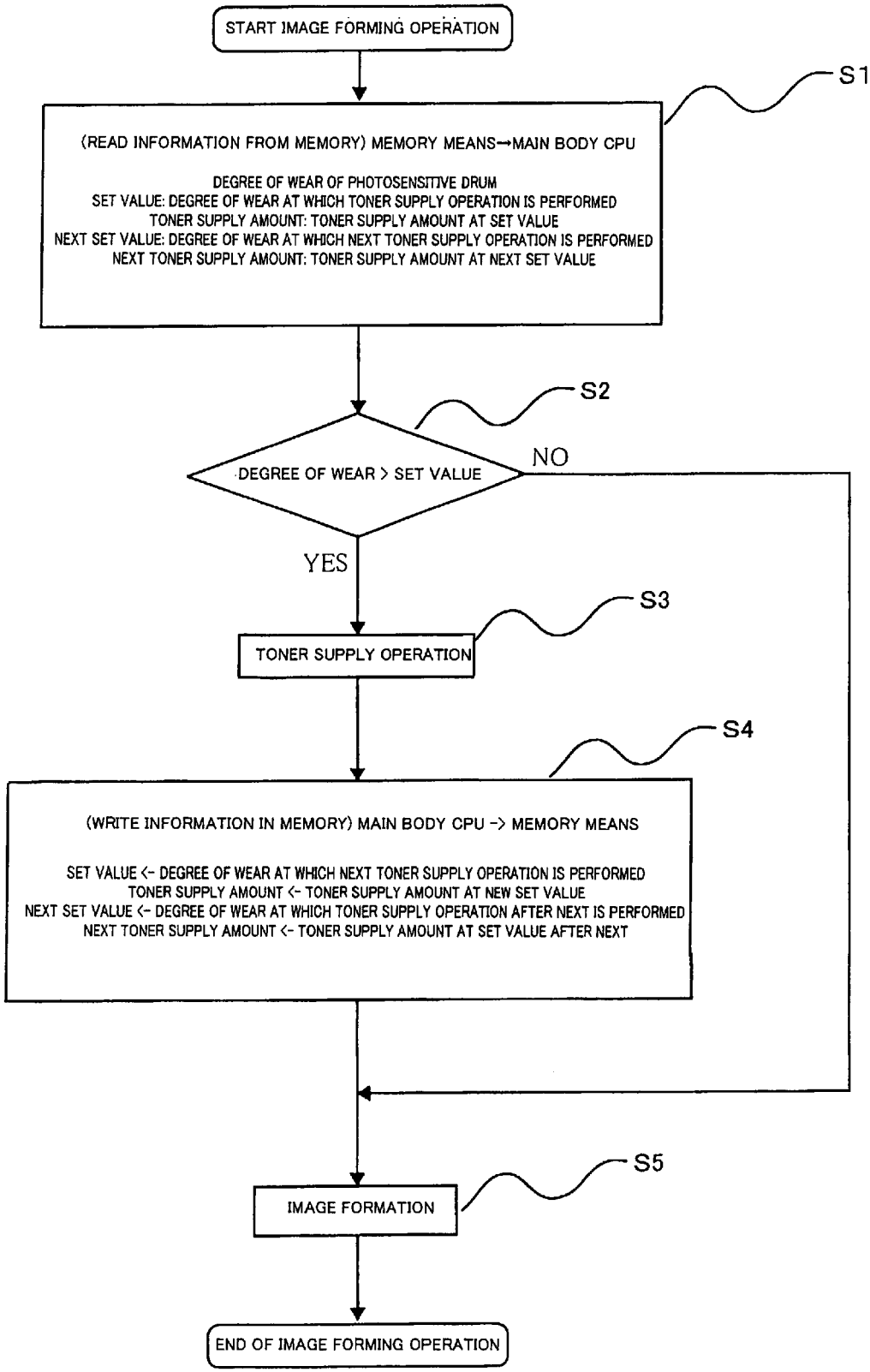
FIG. 7 is a flow chart explaining a sequence of image forming processing in accordance with the fifth embodiments.

Next, a sequence for performing a toner supply operation will be described with reference to FIG. 7.

After starting an image forming operation, information is read from the memory means 25 in step S1.

Contents to be read include degrees of wear of the photosensitive drums 1, a set value, a toner supply amount, the next set value and the next toner supply amount. In step S2, a degree of wear of a photosensitive drum and a set value are compared and, if the degree of wear of the photosensitive drum has not reached the set value representing a time of the toner supply operation, image formation of step 5 is performed directly. If a degree of wear of the photosensitive drum exceeds the set value, the toner supply operation is performed in step S3. Thereafter, the set value, the toner supply amount, the next set value and the next toner supply amount are updated and stored in the memory means 25 in step S4, and image formation is performed in step S5.

In this embodiment, a toner supply amount at the time of the toner supply operation performed in step S3 is changed according to a degree of wear of the photosensitive drum, and toner of an optimal amount is supplied to cleaning means. Then, degrees of wear and supply amounts will be described more in detail with reference to FIG. 8.

Figure 8:
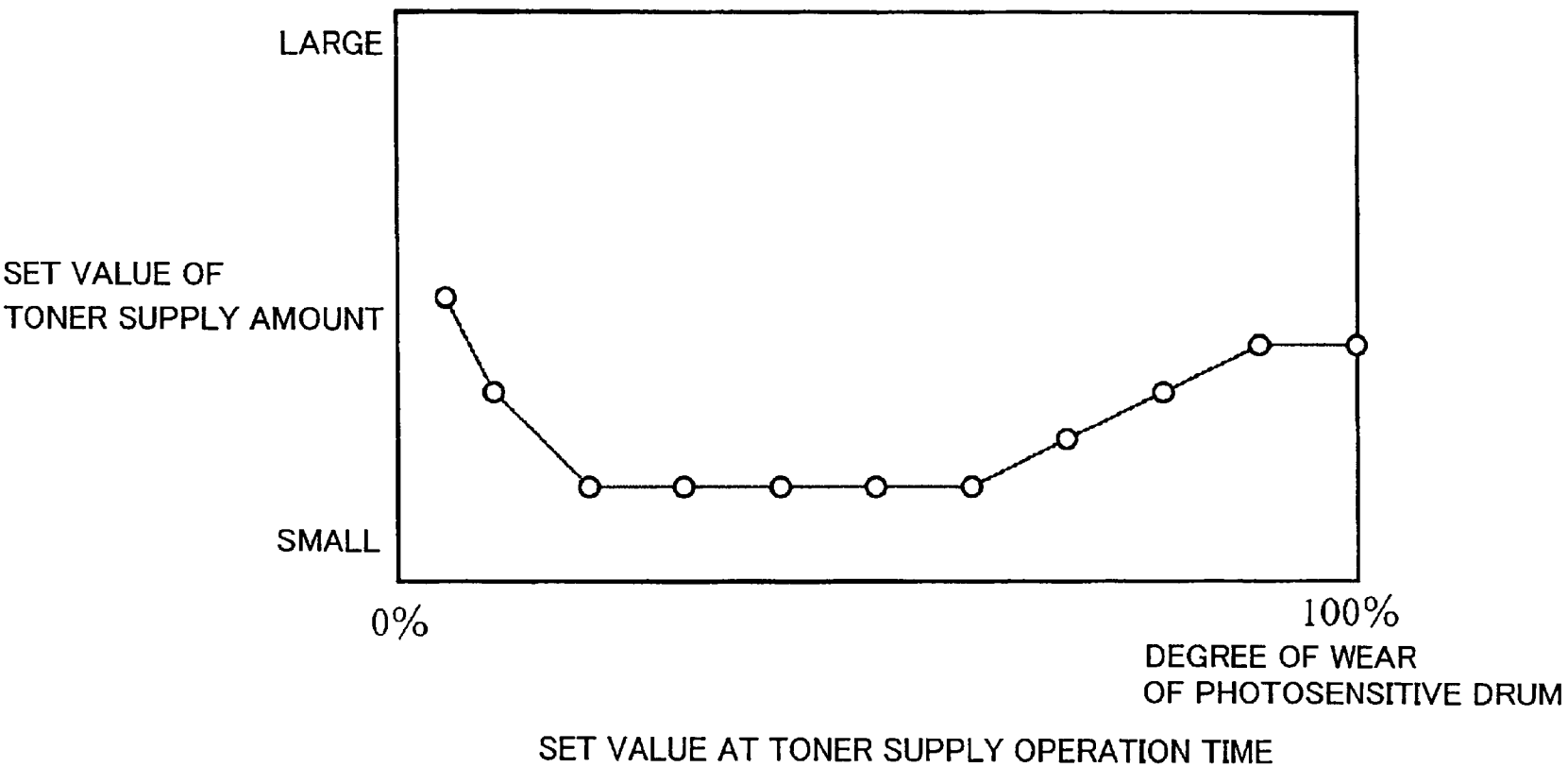
FIG. 8 is a graph showing a relationship between degrees of wear of a photosensitive drum and toner supply amounts at the time of a toner supply operation concerning the image forming apparatus in accordance with the fifth embodiment.

In FIG. 8, the horizontal axis represents degrees of wear of a photosensitive drum and plotted white circles represent set values of times for performing a toner supply operation. The vertical axis represents toner supply amounts at the time of a toner supply operation in each time. Further, in this embodiment, it has been confirmed in an experiment by an inventor that there is a sufficient association between supply amounts and supply times.

Thus, a time during which a developing bias at the time of a toner supply operation is ON and a developing roller is in an abutment state is changed in proportion to the set values of the toner supply amount. According to FIG. 8, the set values are made slightly higher in the beginning and at the end of a usable life of the photosensitive drum. In the beginning, the set values are made slightly higher, whereby rubbing of the photosensitive drum and cleaning means is stabilized. At the end thereof, since the usable life of the photosensitive drum and the cleaning means are exhausted, a toner supply amount is gradually increased in order to stabilize rubbing as well. The set values are made relatively low in the middle of the usable life as compared with the beginning and the end thereof to save an amount of toner consumption.

Figure 9:
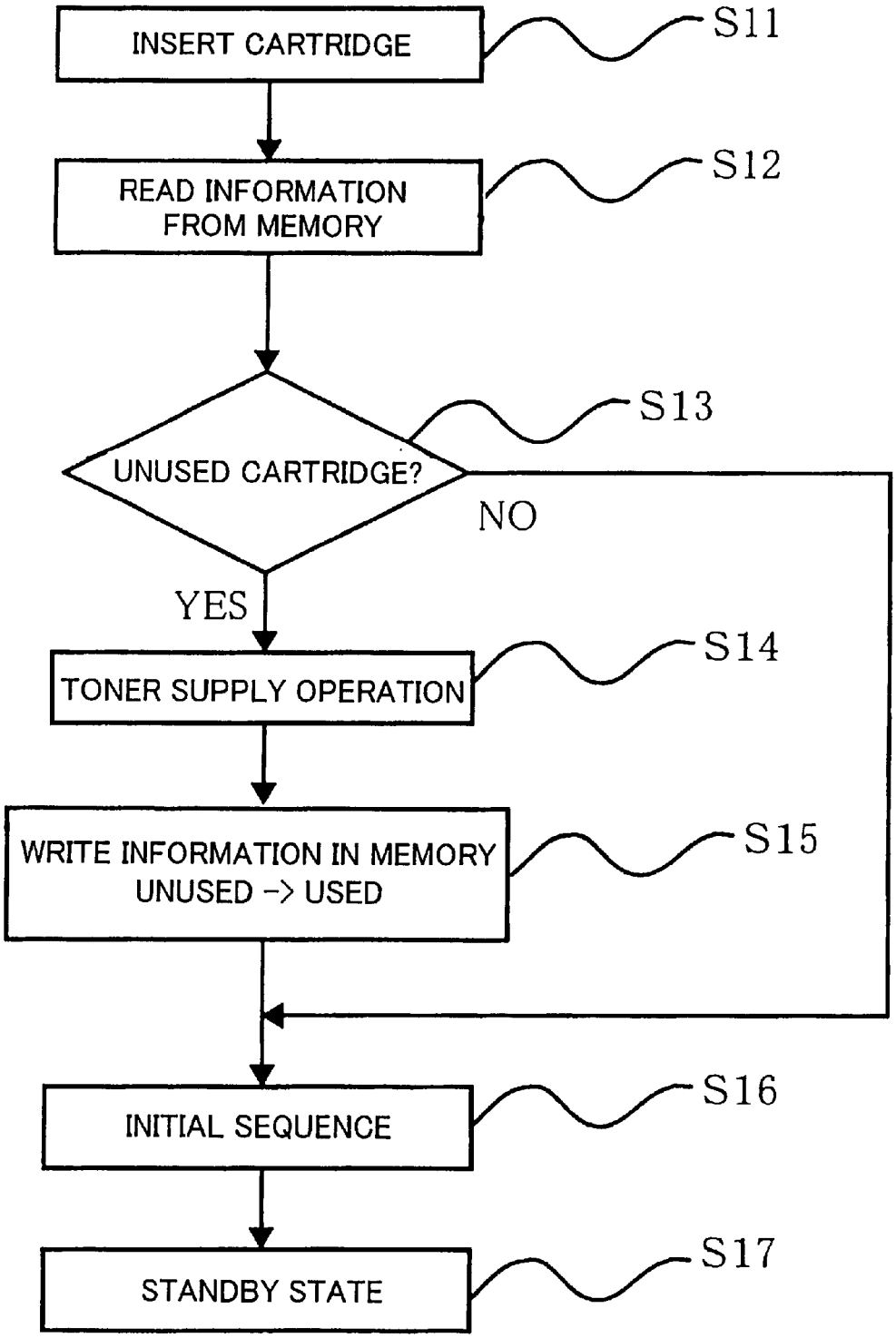
FIG. 9 is a flow chart explaining a sequence of image forming processing in accordance with the fifth embodiment.

Moreover, in this embodiment, states in which a process cartridge is unused or not are stored in the memory means 25 in advance, a toner supply operation is performed according to the information. FIG. 9 represents a sequence of a toner supply operation for an unused cartridge. This will be hereinafter described in detail.

First, a process cartridge is inserted in step S11. If a door is closed or if a power supply of a printer is turned ON, in step S12, information of the memory means 25 is read and information on whether the process cartridge is unused (new) or not is obtained. This information is judged in step S13. If the process cartridge is not unused, an initial sequence (cleaning of a conveyor belt, detection of jammed paper, temperature adjustment of a heat fixing device, etc.) of step S16 begins. If it is judged in step S13 that the process cartridge is unused (new), a toner supply operation is performed in step S14. That is, the toner supply operation is performed before starting an image forming operation. Thereafter, in step S15, information that the process cartridge is the one already used is written in the memory means 25 and, the initial sequence of step S16 begins.

When 10,000 images were formed by the image forming apparatus of this embodiment in the monochrome image forming mode, appropriate lubricity could be always maintained because toner always existed at the nips between the cleaning means 6 and the photosensitive drums 1, and favorable cleaning performance could be kept.

Therefore, it was confirmed that high image quality could be realized for along period such that, for example, defective cleaning, charging unevenness or the like did not occur and uniform half tone images could be obtained even if full color printing is performed immediately after the monochrome image forming mode.

Sixth Embodiment

In the fifth embodiment, information for determining times of a toner supply operation and a toner supply amount in each time is written in the memory means 25 of a process cartridge in advance. Such information may be stored in memory means (not shown) of a CPU on a printer main body side. In this way, time consumed for reading information from and writing information in memory means of the printer main body and the process cartridge can be reduced and a space of a memory area of memory means can be expanded. Thus, it becomes possible to write detailed information concerning a usable life in the memory means.

In addition, as to stability of cleaning performance, effects equivalent to those in the fifth embodiment are realized.

Seventh Embodiment

In this embodiment, the number of images of printing in the monochrome image forming mode for performing printing with developing rollers other than that of black apart from photosensitive drums and the number of images of printing in the full color image forming mode for performing printing with all developing rollers abutting against photosensitive drums are counted and stored in memory means. Then, a toner supply amount is corrected according to a ratio of the numbers of images in these modes.

Figure 10:
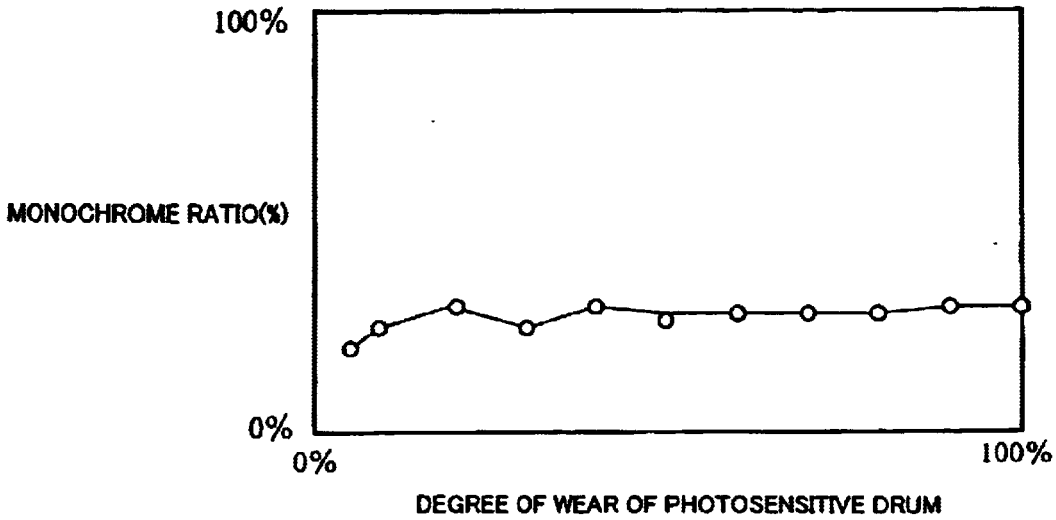
FIG. 10A is a graph showing a relationship between degrees of wear of a photosensitive drum and monochrome ratios concerning an image forming apparatus in accordance with a seventh embodiment.
FIG. 10B is a graph showing a relationship between degrees of wear of a photosensitive drum and set values of a toner supply amount.
Figure 10:
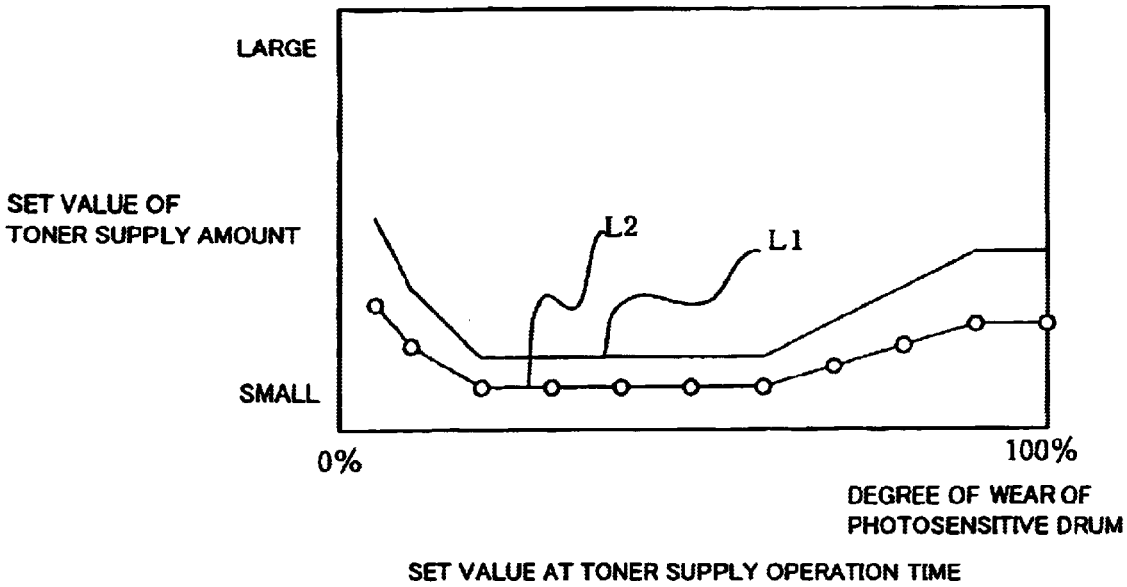

FIG. 10A shows an example of monochrome ratios with respect to degrees of wear of a photosensitive drum. FIG. 10B represents set values of a toner supply amount. In FIG. 10B, L1 is a graph shown in the fifth embodiment. When the monochrome ratio is 100%, set values of L1 are used. Since a photosensitive drum and a developing roller of a black cartridge are always in abutment with each other to perform image formation, a toner supply amount is not corrected. For the other process cartridges, a toner supply amount is corrected to be slightly reduced as the monochrome ratio decreases.

In this way, according to this embodiment, a toner supply amount is corrected to be a more appropriate value according to a ratio of the monochrome image forming mode and the full color image forming mode, whereby stability of cleaning performance can be improved.

Eighth Embodiment

Although a time for supplying toner is determined according to a degree of wear of a photosensitive drum in the above-mentioned fifth to seventh embodiments, it may be determined according to the number of printed images. In addition, although a toner supply amount is controlled according to a time of supply from a developing roller, setting of a potential such as development contrast, peripheral speed increase of a developing roller or the like can also be utilized.

As described above, according to the fifth to seventh embodiments, an appropriate amount of toner is supplied to nips between cleaning means and image bearing members at an appropriate time, whereby stable cleaning of a photosensitive drum can be performed even if a frequency of performing image formation in the monochrome image forming mode is high.

In addition, since the memory means storing timing for supplying toner are provided in the process cartridges to make it possible to change timing for supplying toner according to degrees of wear of the photosensitive drums, stable cleaning can be performed continuously even at the end of a usable life of the photosensitive drums.

Therefore, in an image forming apparatus of a structure in which the developing rollers and the photosensitive drums are spaced apart at the time of the monochrome image forming mode, high quality images can be guaranteed until a usable life peculiar to the apparatus is exhausted without defective cleaning, density unevenness of half tone, or the like.

What is claimed is:

1. An image forming apparatus comprising:

a first image bearing member;

a first developer carrying member for carrying developer and developing an electrostatic image formed on said first image bearing member with the developer;

first cleaning means for cleaning said first image bearing member disposed into contact with said first image bearing member;

a second image bearing member;

a second developer carrying member for carrying developer and developing an electrostatic image formed on said second image bearing member with the developer; and second cleaning means for cleaning said second image bearing member disposed into contact with said second image bearing member, wherein said apparatus can select a first image forming mode in which images are transferred from said first and second image bearing members to an image receiving member and a second image forming mode in which an image is transferred from said first image bearing member to said image receiving member and an image is not transferred from said second image bearing member to said image receiving member, and wherein, in said second image forming mode, said developer is supplied between said second image bearing member and said second cleaning means.

2. An image forming apparatus according to claim 1, wherein, in said second image forming mode, said second developer carrying member can be separated from said second image bearing member.

3. An image forming apparatus according to claim 1, wherein, in said second image forming mode, said second developer carrying member can be separated from said second image bearing member to a position where said second developer carrying member does not apply a development operation to said second image bearing member.

4. An image forming apparatus according to claim 1, wherein, in said second image forming mode, said developer is supplied from said second developer carrying member to said second image bearing member, thereby being supplied between said second image bearing member and said second cleaning means.

5. An image forming apparatus according to claim 1, wherein, in said second image forming mode, said second developer carrying member is moved from a position where said second developer carrying member does not apply a development operation to said second image bearing member to a position where said second developer carrying member can apply a development operation to said second image bearing member, and said developer is supplied from said second developer carrying member to said second image bearing member, thereby being supplied between said second image bearing member and said second cleaning means.

6. An image forming apparatus according to claim 1, wherein, in said first image forming mode and said second image forming mode, said first and second image bearing members rotate.

7. An image forming apparatus according to claim 6, wherein said apparatus is provided with an image receiving member carrying body for carrying said image receiving member from an image transfer position of said first image bearing member to an image transfer position of said second image bearing member, and said image receiving member carrying body is provided in contact with said first and second image bearing members.

8. An image forming apparatus according to claim 1, wherein said apparatus is provided with memory means for storing information with relation to a state of use of said second image bearing member, and in said second image forming mode, a supply operation of said developer supplied between said second image bearing member and said second cleaning means is performed according to said information.

9. An image forming apparatus according to claim 8, wherein said second image bearing member and said second cleaning means are provided in a process cartridge detachably attachable to a main body of said apparatus, and said process cartridge is provided with said memory means.

10. An image forming apparatus according to claim 1, wherein, in said second image forming mode, a developer supply amount in the supply operation of said developer supplied between said second image bearing member and said second cleaning means is made variable.

11. An image forming apparatus according to claim 9, wherein, in said second image forming mode, a developer supply amount in the supply operation of said developer supplied between said second image bearing member and said second cleaning means is made variable according to said information.

12. An image forming apparatus according to claim 1, wherein said second image bearing member and said second cleaning means are provided in a process cartridge detachably attachable to a main body of said apparatus, and a supply operation of said developer supplied between said second image bearing member and said second cleaning means is performed during a period from a time when said process cartridge is unused until a time when an image forming operation is performed first.

13. An image forming apparatus according to claim 9, wherein a supply operation of said developer supplied between said second image bearing member and said second cleaning means is performed, and at the same time, information that said process cartridge is not unused is stored in said memory means during a period from a time when said process cartridge is unused until a time when an image forming operation is performed first.

14. An image forming apparatus according to claim 1, wherein said apparatus is provided with other image bearing members that are capable of transferring images to said image receiving member, and images are transferred from said other image bearing members to said image receiving members in said first image forming mode and an image is transferred only from said first image bearing member to said image receiving member in said second image forming mode.

15. An image forming apparatus according to claim 14, wherein full color image formation is performed in said first image forming mode and monochrome image formation is performed in said second image forming mode.

16. An image forming apparatus comprising:

a first image bearing member;

a first developer carrying member for carrying developer and developing an electrostatic image formed on said first image bearing member with the developer;

first cleaning means for cleaning said first image bearing member disposed into contact with said first image bearing member;

a second image bearing member;

a second developer carrying member for carrying developer and developing an electrostatic image formed on said second image bearing member with the developer, said second developer carrying member being capable of coming into contact with and separating from said second image bearing member; and second cleaning means for cleaning said second image bearing member disposed into contact with said second image bearing member, wherein said apparatus can select a first image forming mode in which images are transferred from said first and second image bearing members to an image receiving member and a second image forming mode in which an image is transferred from said first image bearing member to said image receiving member and an image is not transferred from said second image bearing member to said image receiving member, and wherein, in said second image forming mode, said second developer carrying member can be separated from said second image bearing member to a position where said second developer carrying member does not apply a development operation to said second image bearing member, and said developer is supplied between said second image bearing member and said second cleaning means.

17. An image forming apparatus according to claim 16, wherein, in said second image forming mode, said developer is supplied from said second developer carrying member to said second image bearing member, thereby being supplied between said second image bearing member and said second cleaning means.

18. An image forming apparatus according to claim 16, wherein, in said second image forming mode, said second developer carrying member is moved from a position where said second developer carrying member separates from said second image bearing member to a position where said second developer carrying member comes into contact with said second image bearing member, and said developer is supplied from said second developer carrying member to said second image bearing member, thereby being supplied between said second image bearing member and said second cleaning means.

19. An image forming apparatus according to claim 16, wherein, in said first image forming mode and said second image forming mode, said first and second image bearing members rotate.

20. An image forming apparatus according to claim 19, wherein said apparatus is provided with an image receiving member carrying body for carrying said image receiving member from an image transfer position of said first image bearing member to an image transfer position of said second image bearing member, and said image receiving member carrying body is provided in contact with said first and second image bearing members.

21. An image forming apparatus according to claim 16, wherein said apparatus is provided with memory means for storing information with relation to a state of use of said second image bearing member, and in said second image forming mode, a supply operation of said developer supplied between said second image bearing member and said second cleaning means is performed according to said information.

22. An image forming apparatus according to claim 21, wherein said second image bearing member and said second cleaning means are provided in a process cartridge detachably attachable to a main body of said apparatus, and said process cartridge is provided with said memory means.

23. An image forming apparatus according to claim 16, wherein, in said second image forming mode, a developer supply amount in the supply operation of said developer supplied between said second image bearing member and said second cleaning means is made variable.

24. An image forming apparatus according to claim 22, wherein, in said second image forming mode, a developer supply amount in the supply operation of said developer supplied between said second image bearing member and said second cleaning means is made variable according to said information.

25. An image forming apparatus according to claim 16, wherein said second image bearing member and said second cleaning means are provided in a process cartridge detachably attachable to a main body of said apparatus, and a supply operation of said developer supplied between said second image bearing member and said second cleaning means is performed during a period from a time when said process cartridge is unused until a time when an image forming operation is performed first.

26. An image forming apparatus according to claim 22, wherein a supply operation of said developer supplied between said second image bearing member and said second cleaning means is performed, and at the same time, information that said process cartridge is not unused is stored in said memory means during a period from a time when said process cartridge is unused until a time when an image forming operation is performed first.

27. An image forming apparatus according to claim 16, wherein said apparatus is provided with other image bearing members that are capable of transferring images to said image receiving member, and images are transferred from said other image bearing members to said image receiving members in said first image forming mode and an image is transferred only from said first image bearing member to said image receiving member in said second image forming mode.

28. An image forming apparatus according to claim 27, wherein full color image formation is performed in said first image forming mode and monochrome image formation is performed in said second image forming mode.

* * * * *

UNITED STATES PATENT AND TRADEMARK OFFICE

CERTIFICATE OF CORRECTION

PATENT NO. : 6,771,924 B2
DATED : August 3, 2004
INVENTOR(S) : Minoru Matsuguma

It is certified that error appears in the above-identified patent and that said Letters Patent is hereby corrected as shown below:

Title page,
Item [30], Foreign Application Priority Data,
"Jan. 23, 2002 (JP) …… 2001-014465" should read
-- Jan. 23, 2002 (JP) …….. 2002-014465 --.

Column 1,
Line 25, "farming" should read -- forming --.

Column 5,
Line 31, "their" should be deleted;
Line 32, "both" should read -- both of their --; and
Line 34, "portions." should read -- portion. --.

Column 6,
Line 19, "Sand" should read -- S and --.

Column 12,
Line 60, "along" should read -- a long --.

Signed and Sealed this

Twelfth Day of October, 2004

JON W. DUDAS
*Director of the United States Patent and Trademark Office*